US008573803B2

(12) United States Patent
Satou et al.

(10) Patent No.: US 8,573,803 B2
(45) Date of Patent: Nov. 5, 2013

(54) ILLUMINATION DEVICE

(75) Inventors: Kiminori Satou, Yachiyo (JP); Takayuki Shimizu, Hirakata (JP); Osamu Hikone, Ichikawa (JP); Mayumi Saitou, Misato (JP)

(73) Assignee: Panasonic Corporation, Osaka (JP)

( * ) Notice: Subject to any disclaimer, the term of this patent is extended or adjusted under 35 U.S.C. 154(b) by 320 days.

(21) Appl. No.: 13/190,880

(22) Filed: Jul. 26, 2011

(65) Prior Publication Data

US 2012/0026736 A1 Feb. 2, 2012

(30) Foreign Application Priority Data

Jul. 27, 2010 (JP) ..... 2010-168235
Jul. 27, 2010 (JP) ..... 2010-168236
Jul. 27, 2010 (JP) ..... 2010-168237

(51) Int. Cl.
*F21V 7/00* (2006.01)

(52) U.S. Cl.
USPC ..... 362/247; 362/243; 362/84

(58) Field of Classification Search
USPC ..... 362/247, 243, 84, 227, 235, 306
See application file for complete search history.

(56) References Cited

U.S. PATENT DOCUMENTS 7,712,935 B2 5/2010 Tsukamoto et al.

FOREIGN PATENT DOCUMENTS

JP 2008-226788 9/2008

*Primary Examiner* — Vip Patel
(74) *Attorney, Agent, or Firm* — Bacon & Thomas, PLLC

(57) ABSTRACT

An illumination device includes a housing having a light-emitting surface through which illumination light is irradiated and a plurality of LED units fixed to the housing in specified positions to emit the illumination light. The illumination device further includes a plurality of reflectors each having a reflection surface for reflecting the illumination light emitted from each of the LED units in a specified direction and a reflector attachment plate removably fixed to the housing. Each of the reflectors is adjustably attached to the reflector attachment plate in a specified orientation.

8 Claims, 15 Drawing Sheets

ILLUMINATION DEVICE

FIELD OF THE INVENTION

The present invention relates to an illumination device for irradiating light coming from an LED unit in a specified direction through a reflector having a curvilinear reflection surface.

BACKGROUND OF THE INVENTION

There is conventionally known an illumination device for irradiating light coming from an LED unit in a specified direction through a reflector having a curvilinear reflection surface (see, e.g., Japanese Patent Application Publication No. 2008-226788 (JP2008-226788A), FIG. 2)

Referring to FIG. 15, the illumination device 100 disclosed in JP2008-226788A is used as a vehicle lamp unit and includes an LED package 101 as a light source and a reflector 102. The illumination device 100 is built in a front end portion of a motor vehicle and is used as a reflection-type lamp unit for emitting irradiation light along an optical axis AX.

The LED package 101 includes an LED chip 101A and a substrate 101B for supporting the LED chip 101A. The substrate 101B is attached parallel to the optical axis AX. This means that the major optical axis of the LED package 101 is orthogonal to the optical axis AX.

The reflector 102 has a revolution-paraboloid-type reflection surface 103 whose center axis coincides with the optical axis AX and whose focal point lies on the light-emitting center of the LED package 101, namely on the LED chip 101A. A direct light control member 104 for interrupting the direct light coming from the LED package 101 is arranged at the front side of the irradiation direction near the LED package 101.

The LED package 101, the reflector 102 and the direct light control member 104 are attached to a generally L-shaped metal bracket 105. The metal bracket 105 includes a vertical wall 106 and heat-dissipating fins 107 formed at the rear side of the vertical wall 106.

Therefore, the light emitted from the LED package 101 is reflected by the reflection surface 103 and irradiated as parallel light traveling along the optical axis AX. At this time, the direct light is interrupted by the direct light control member 104. Thus, no direct light is irradiated on a specified area.

When replacing the LED package 101, it is necessary to remove the reflector 102 in usual cases. Since the illumination device 100 disclosed in JP2008-226788A is used as a single body, the reflector 102 is first removed to perform replacement of the LED package. Thereafter, the reflector 102 is attached again.

In case of an illumination device provided with a plurality of LED packages and a plurality of reflectors, it is sometimes the case that the orientations of the respective reflectors are finely adjusted to change the area to be irradiated. In this case, the task of individually removing each of the reflectors to replace one of the LED packages is troublesome. Another problem resides in that the fine adjustment performed after attachment of the reflector is cumbersome and may impair the ease of work.

In an illumination device that makes use of LEDs, the heat radiation performance thereof needs to be improved because an increased amount of heat is generated along with an increase in the output power of the LEDs. In particular, there is a problem in that heat radiation is hard to perform in a sealed device.

Turning back to the illumination device 100 disclosed in JP2008-226788A, the substrate 101B for supporting the LED chip 101A is attached parallel to the optical axis AX. Therefore, the major optical axis of the LED package 101 is orthogonal to the optical axis AX. This reduces the effective reflection area on the curvilinear reflection surface and leads to insufficient reflection efficiency. From the standpoint of energy saving, it is required to improve the reflection efficiency.

SUMMARY OF THE INVENTION

In view of the above, the present invention provides an illumination device capable of allowing a plurality of reflectors to be removed together and capable of eliminating the need to adjust the orientations of the reflectors after installation.

The present invention also provides an illumination device capable of efficiently diffusing and dissipating the heat generated in LEDs.

In addition, the present invention provides an illumination device capable of increasing reflection efficiency.

In accordance with a first aspect of the present invention, there is provided an illumination device including: a housing having a light-emitting surface through which illumination light is irradiated; a plurality of LED units fixed to the housing in specified positions to emit the illumination light; a plurality of reflectors each having a reflection surface for reflecting the illumination light emitted from each of the LED units in a specified direction; and a reflector attachment plate removably fixed to the housing, each of the reflectors being adjustably attached to the reflector attachment plate in a specified orientation.

The reflector attachment plate may have reflector openings to which the reflectors are fitted partially.

The reflector attachment plate may include a reinforcing rib provided on an irradiation direction surface of the reflector attachment plate, the reinforcing ribs also serving as a louver.

In accordance with a second aspect of the present invention, there is provided an illumination device including: a housing having a light-emitting surface through which illumination light is irradiated; a plurality of LED units for emitting the illumination light to be irradiated through the light-emitting surface; a plurality of heat-dissipating LED attachment blocks fixed to the housing to hold the LED units in specified orientations, respectively; and a plurality of heat-dissipating members through which the LED units are attached to the LED attachment blocks, respectively.

The illumination device may further include a connection plate configured to interconnect and unify the heat-dissipating members.

In accordance with a third aspect of the present invention, there is provided an illumination device including: a housing having a light-emitting surface through which illumination light is irradiated; at least one LED unit fixed to the housing in a specified position to emit the illumination light; and a reflector having a curvilinear reflection surface for reflecting the illumination light emitted from the LED unit in a specified direction, wherein the LED unit is arranged near a bottom portion of the reflector such that the angle θ between a major optical axis of the LED unit and a center axis of the LED unit extending toward a large opening of the reflector becomes smaller than 90 degrees.

The illumination device may further include a reflection plate configured to reflect the illumination light, which is emitted from the LED unit but deviated from the reflector, in a specific direction.

With such configurations, the reflectors are attached to the reflector attachment plate in a state that the orientations of the reflectors are adjusted to allow the reflection surfaces to reflect the illumination lights coming from the LED units in specified directions. The reflector attachment plate is removably attached to the housing. Therefore, the reflectors can be removed together by detaching the reflector attachment plate. Likewise, the reflectors can be attached together in specified orientations with no readjustment by merely fixing the reflector attachment plate to the housing in a specified position. This makes it possible to provide an illumination device capable of significantly enhancing the work efficiency.

In addition, the LED units are arranged such that the angle θ between the major optical axis of each of the LED units attached near the bottom portions of the reflectors and the center axis extending toward the large diameter opening of each of the reflectors becomes smaller than 90 degrees. This makes it possible to provide an illumination device capable of increasing the effective reflection surface of each of the reflectors and capable of efficiently irradiating the light in a desired direction.

BRIEF DESCRIPTION OF THE DRAWINGS

The objects and features of the present invention will become apparent from the following description of embodiments, given in conjunction with the accompanying drawings, in which.

DETAILED DESCRIPTION OF THE PREFERRED EMBODIMENTS

First Embodiment

An illumination device according to a first embodiment of the present invention will now be described with reference to the accompanying drawings.

Figure 1:
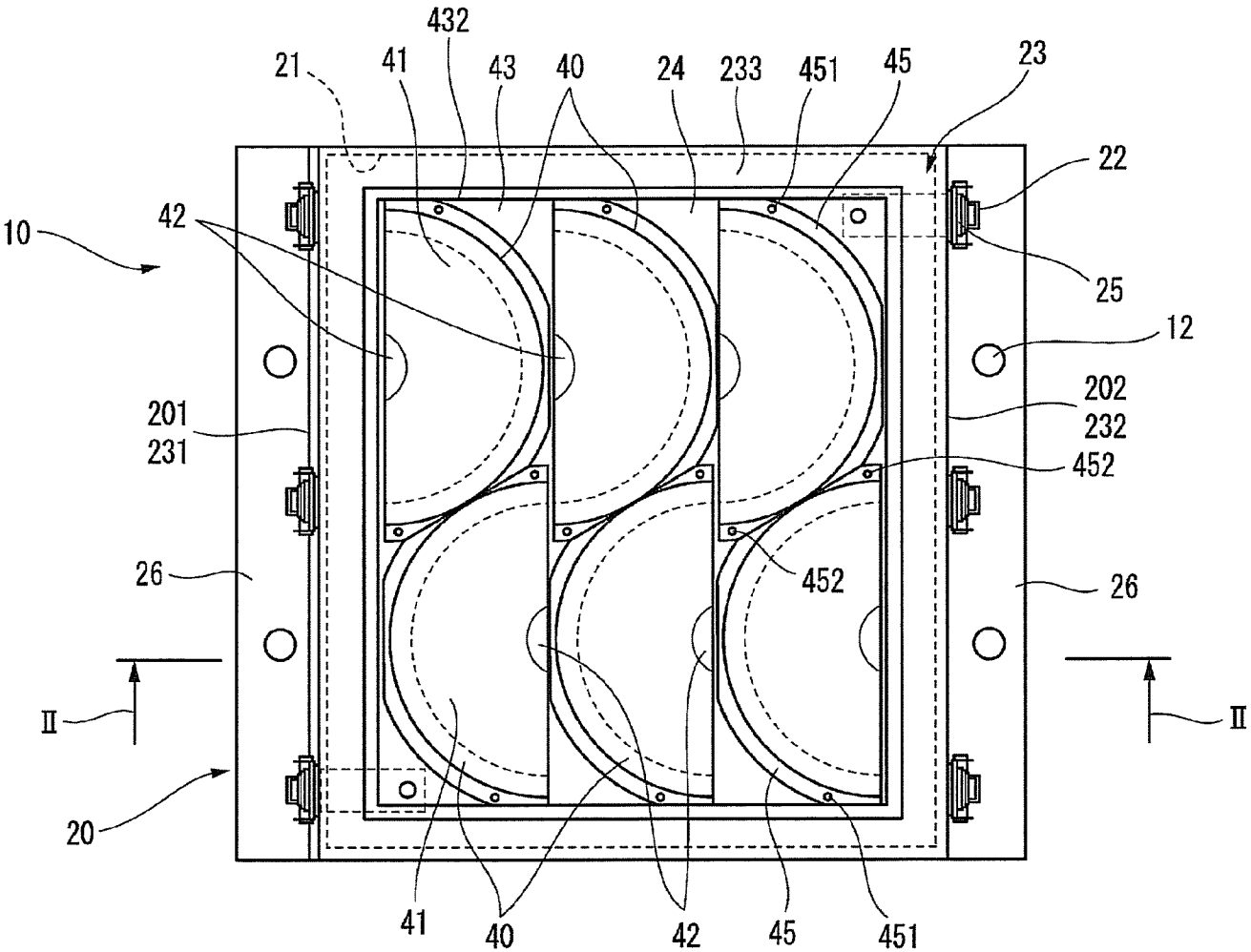
FIG. 1 is a plan view showing an illumination device according to a first embodiment of the present invention.
Figure 2:
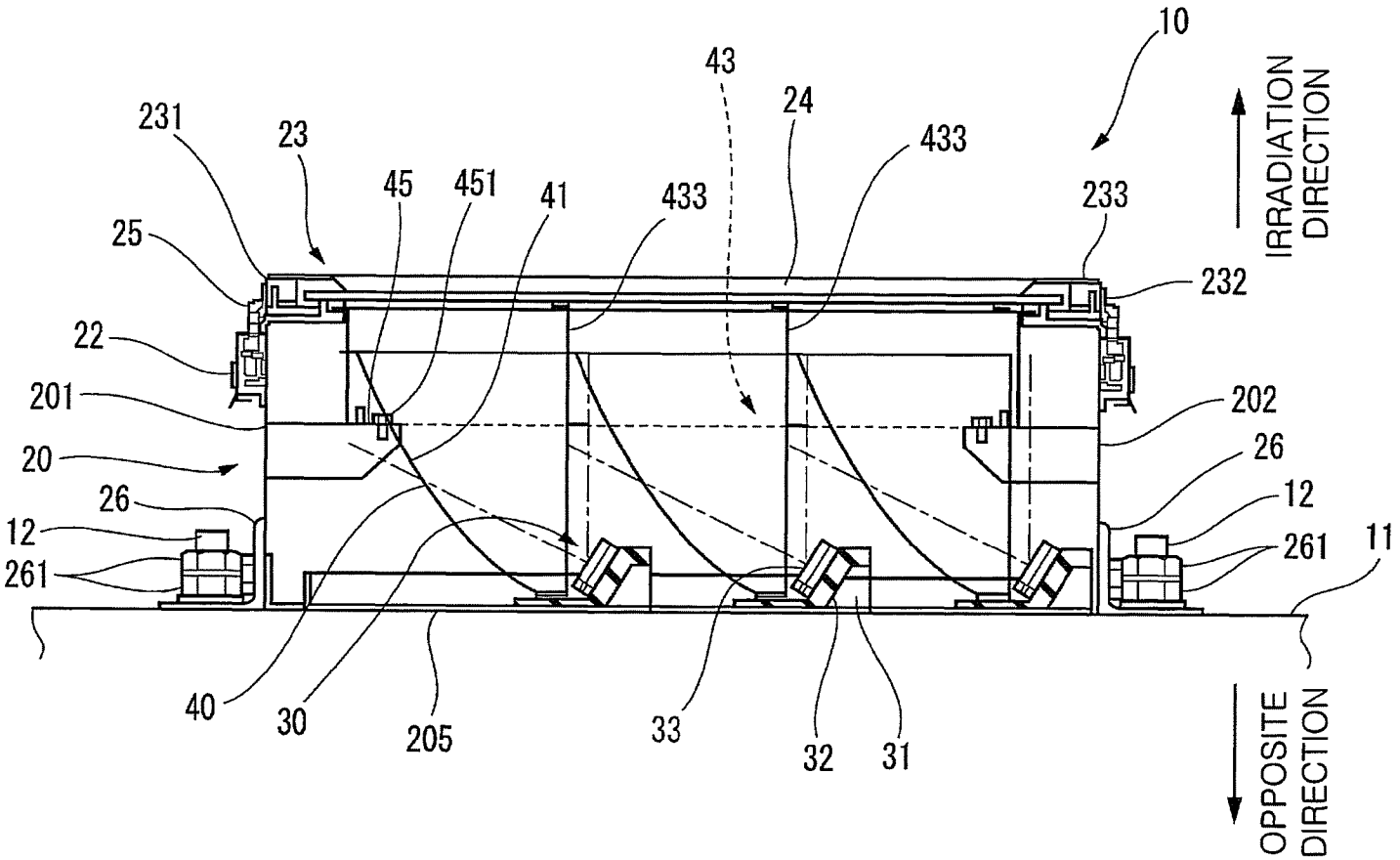
FIG. 2 is a section view of the illumination device taken along line II-II in FIG. 1.

Referring to FIGS. 1 and 2, the illumination device 10 according to the first embodiment of the present invention is a light-up illumination device including a housing 20, a plurality of LED units 30 and a plurality of reflectors 40.

While the following description is directed to a case where the illumination device 10 is provided with six LED units 30 and six reflectors 40, the number of the LED units 30 and the reflectors 40 is not limited to six.

The housing 20 is formed into a rectangular box shape by, e.g., press-forming a thin aluminum-die-cast plate member, and is opened at the upper side thereof in FIG. 2 to have an opening 21. A thin rectangular box-shaped cover 23 opened at the lower side thereof is removably fitted to the opening 21 of the housing 20 to close the opening 21. The cover 23 includes a rim portion 233 of rectangular frame shape. A light-transmitting panel 24 made of, e.g., acryl resin, is attached to the rim portion 233, thereby making up a light-emitting surface.

A plurality of (three, in the illustrated embodiment) first locking members 22 is provided on each of the outer surfaces of two mutually-opposing side walls 201 and 202 of the housing 20. In a corresponding relationship with the first locking members 22, a plurality of second locking members 25 is provided on each of the outer surfaces of two mutually-opposing walls 231 and 232 of the cover 23 mating with the two mutually-opposing side walls 201 and 202 of the housing 20. The first locking members 22 and the second locking members 25 can be interlocked with each other.

One side of the cover 23 may be hingedly attached to one side of the housing 20 so that the cover 23 can be opened and closed with respect to the housing 20. In this case, locking members for locking the cover 23 may be provided in the opposite sides of the housing 20 and the cover 23.

Fixing members 26 each having an L-like cross-sectional shape are attached to the lower end areas of the outer surfaces of the two mutually-opposing side walls 201 and 202 of the housing 20. The fixing members 26 are removably secured to a structural body 11 by tightening nuts 261 to bolts 12 fixed to the structural body 11.

As shown in FIGS. 1 and 2, six LED units 30 are provided at specified positions on the bottom surface 205 of the housing 20 such that three of the LED units 30 face in one direction with the remaining three LED units 30 facing in the opposite direction.

Figure 3A:
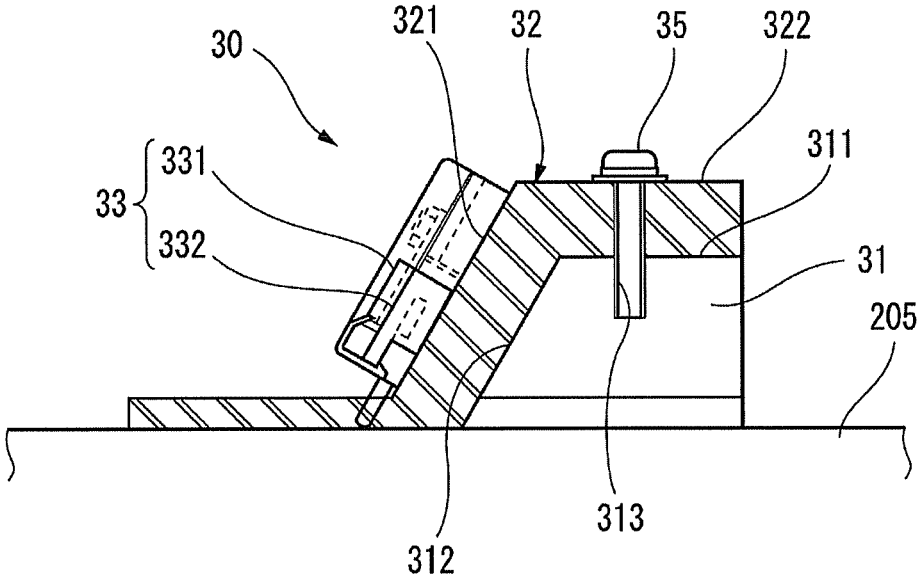
FIGS. 3A and 3B are sectional and perspective views showing one of LED units.
Figure 3B:
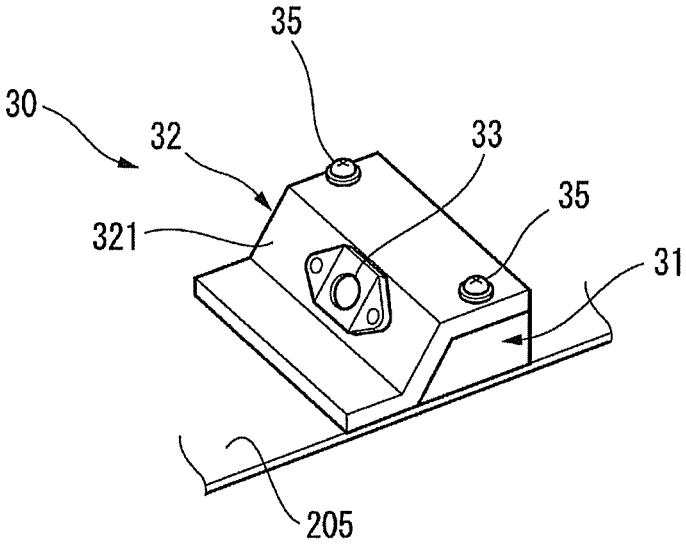

Referring to FIGS. 2, 3A and 3B, each of the LED units 30 includes an LED attachment block 31 that is an elongate member of trapezoidal cross section with heat dissipation property, which is attached to the bottom surface 205 of the housing 20, and a heat-dissipating member 32 for covering top and slant surfaces 311 and 312 of the LED attachment block 31 and a portion of the bottom surface 205 of the housing 20. The heat-dissipating member 32 is fixed to the LED attachment block 31 by driving screws 35 into thread holes 313 formed on the top surface 311 of the LED attachment block 31.

An LED package 33 is attached to the slant surface 312 of the LED attachment block 31 through a slant surface 321 of the heat-dissipating member 32. Each of the LED units 30 is attached such that, as shown in FIG. 10B, the angle θ between the major optical axis LX thereof and the center axis AX extending toward a large opening 401 (see FIG. 7) of each of the reflectors 40 becomes smaller than 90 degrees.

Referring to FIG. 3A, the LED package 33 includes an LED chip 331 and a substrate 332 for mounting the LED chip 331 thereon.

Figure 4:
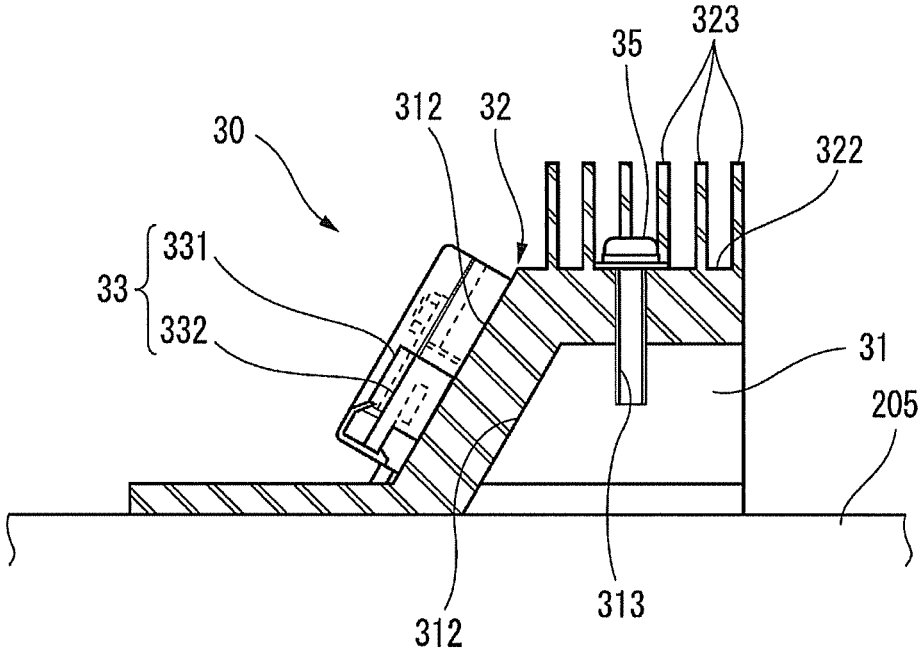
FIG. 4 is a section view showing a modified example of the LED unit shown in FIGS. 3A and 3B.

As shown in FIG. 4, a plurality of heat-dissipating ribs 323 may be provided on the top surface 322 of the heat-dissipating member 32.

Figure 5A:
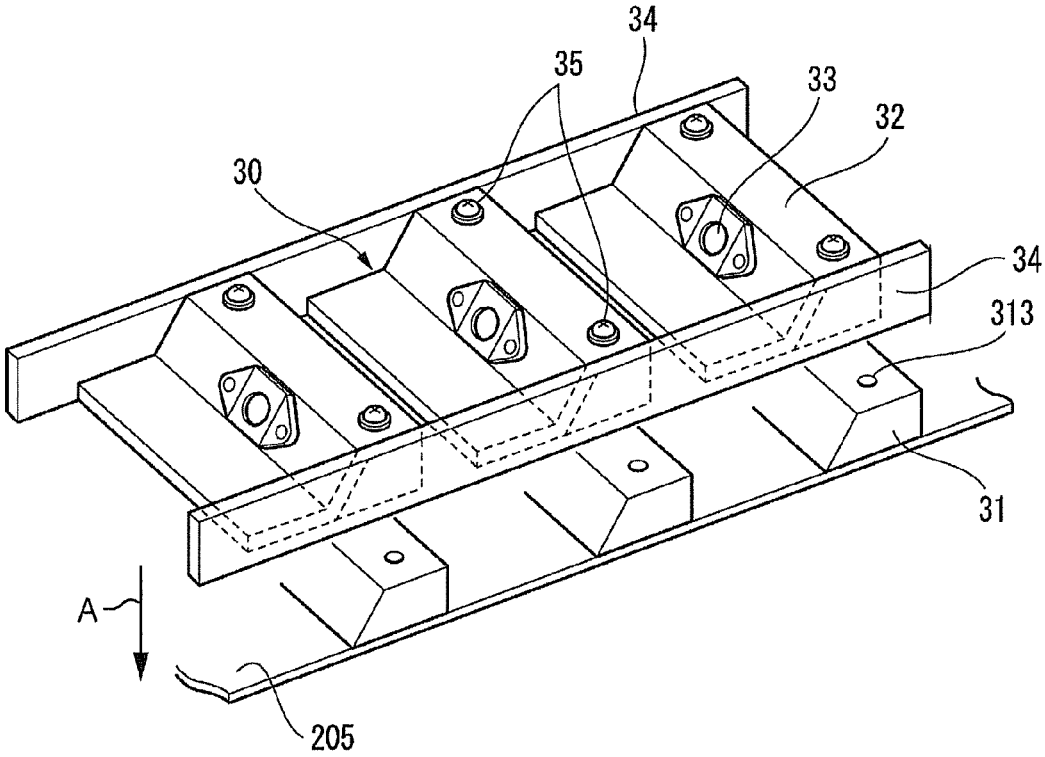
FIG. 5A is an exploded perspective view illustrating an installation state of three LED units and FIG. 5B is a perspective view depicting an attachment example of a power supply unit.

Referring to FIG. 5A, the longitudinal opposite end surfaces of the heat-dissipating members 32 of the three LED units 30 oriented in the same direction are interconnected by connection plates 34 in a ladder shape. The heat-dissipating members 32 are integrated with each other while being arranged at the same interval as the interval of the LED attachment blocks 31 fixed to the bottom surface 205 of the housing 20. The heat-dissipating members 32 are put on the LED attachment blocks 31 in the direction indicated by arrow A in FIG. 5A and are fixed to the LED attachment blocks 31 by screws 35.

Two sets of the three heat-dissipating members 32 unified by the connection plates 34 are attached on the bottom surface 205 of the housing 20 in the opposite orientations to each other (see FIG. 1).

Figure 5B:
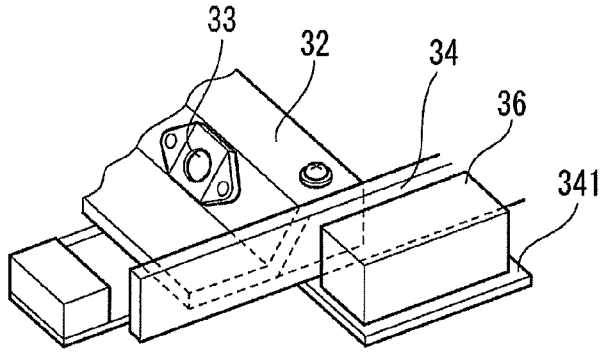

As shown in FIG. 5B, a support base 341 may be provided outside one of the connection plates 34, and a power supply unit 36 for supplying electric power to the LED packages 33 may be arranged on the support base 341.

Figure 7:
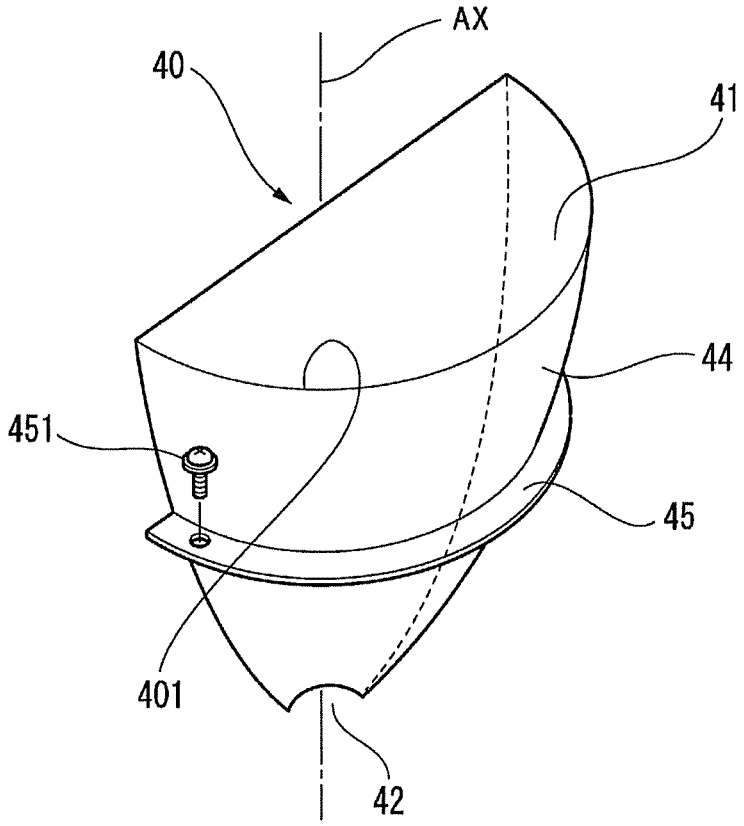
FIG. 7 is a perspective view of one of reflectors as seen from the light irradiating side.
Figure 8:
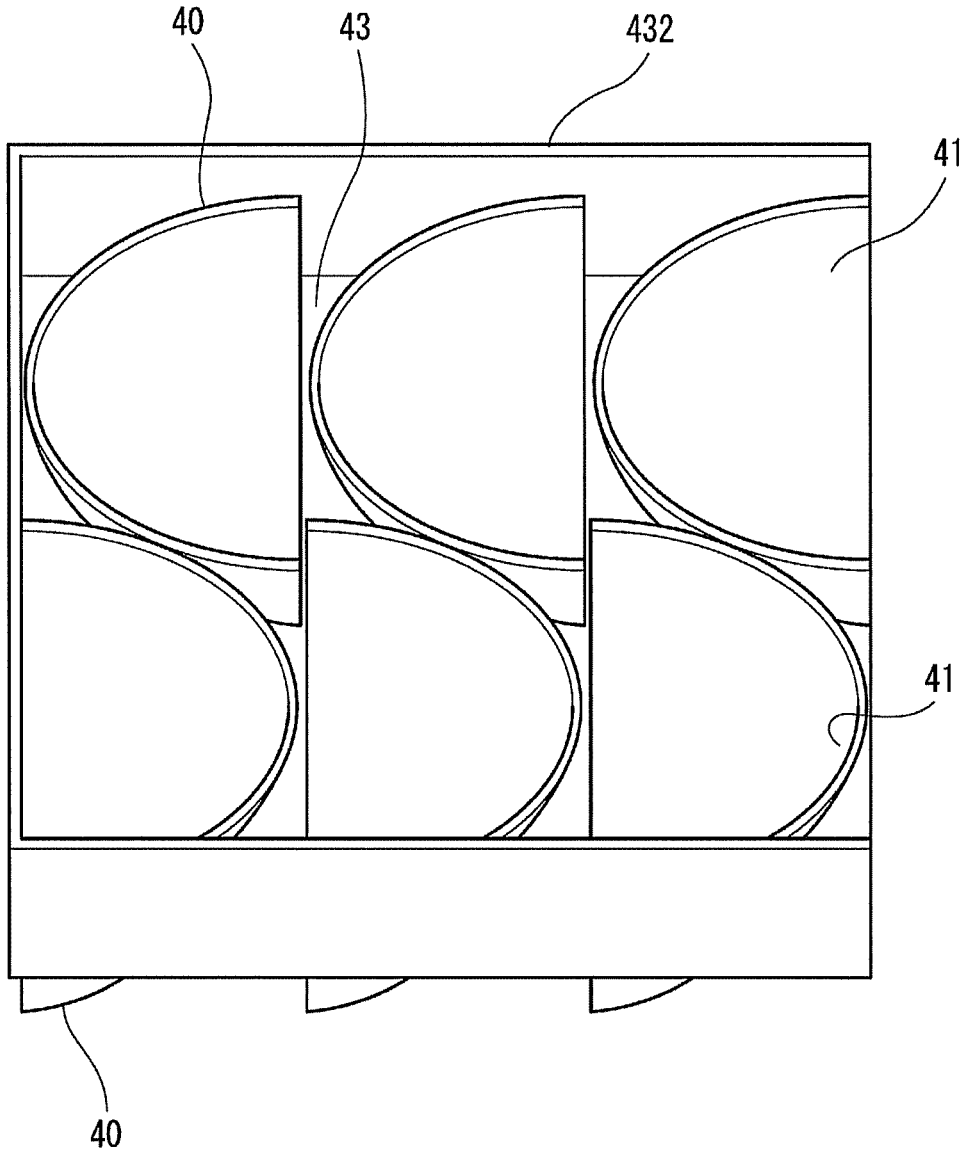
FIG. 8 is a perspective view of the reflector attachment plate with the reflectors attached thereto, which is seen from the light irradiating side.
Figure 9:
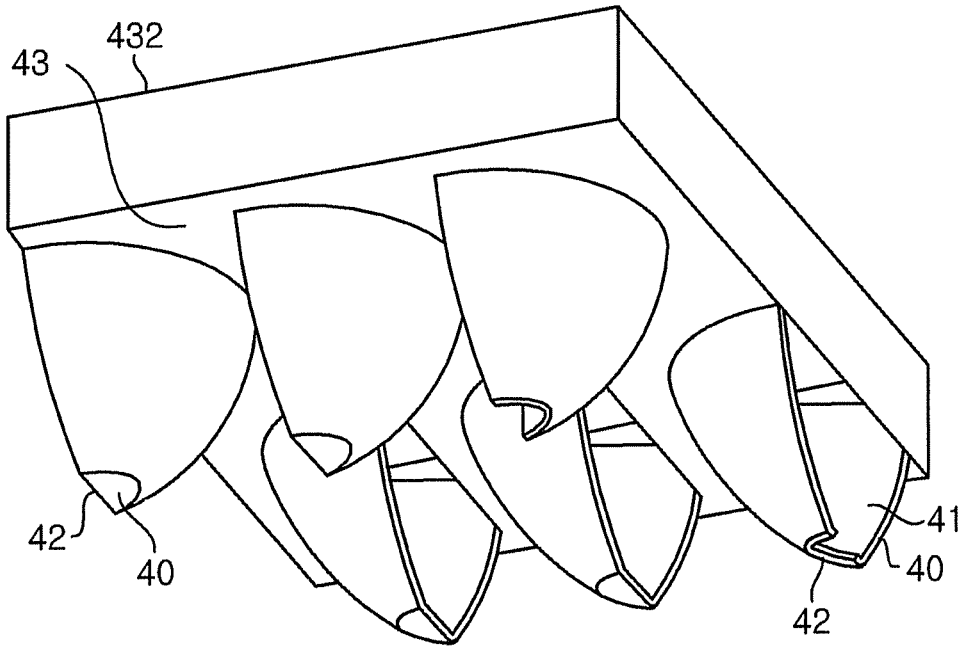
FIG. 9 is a perspective view of the reflector attachment plate with the reflectors attached thereto, which is seen from the opposite side to the light irradiating side.

Referring back to FIGS. 1 and 2, the reflectors 40 are provided around the LED units 30. As can be seen in FIG. 7, each of the reflectors 40 has a shape like one half part of a parabola-curve revolution body obtained by rotating a parabolic line about the center axis AX. Each of the reflectors 40 includes an internal surface serving as a reflection surface 41. The reflection surface 41 is mirror-finished by, e.g., aluminum vapor deposition. In the bottom portion of each of the reflectors 40, there is provided a LED unit opening 42 through which the illumination light coming from each of the LED units 30 is irradiated toward the reflection surface 41. The large opening 401 having a semicircular shape is provided at the tip end (the upper end in FIG. 7) of each of the reflectors 40 in the irradiation direction.

In the middle-height area of an outer peripheral surface 44 of each of the reflectors 40, there is provided a flange portion 45 protruding outwards along a plane orthogonal to the center axis AX.

Figure 6:
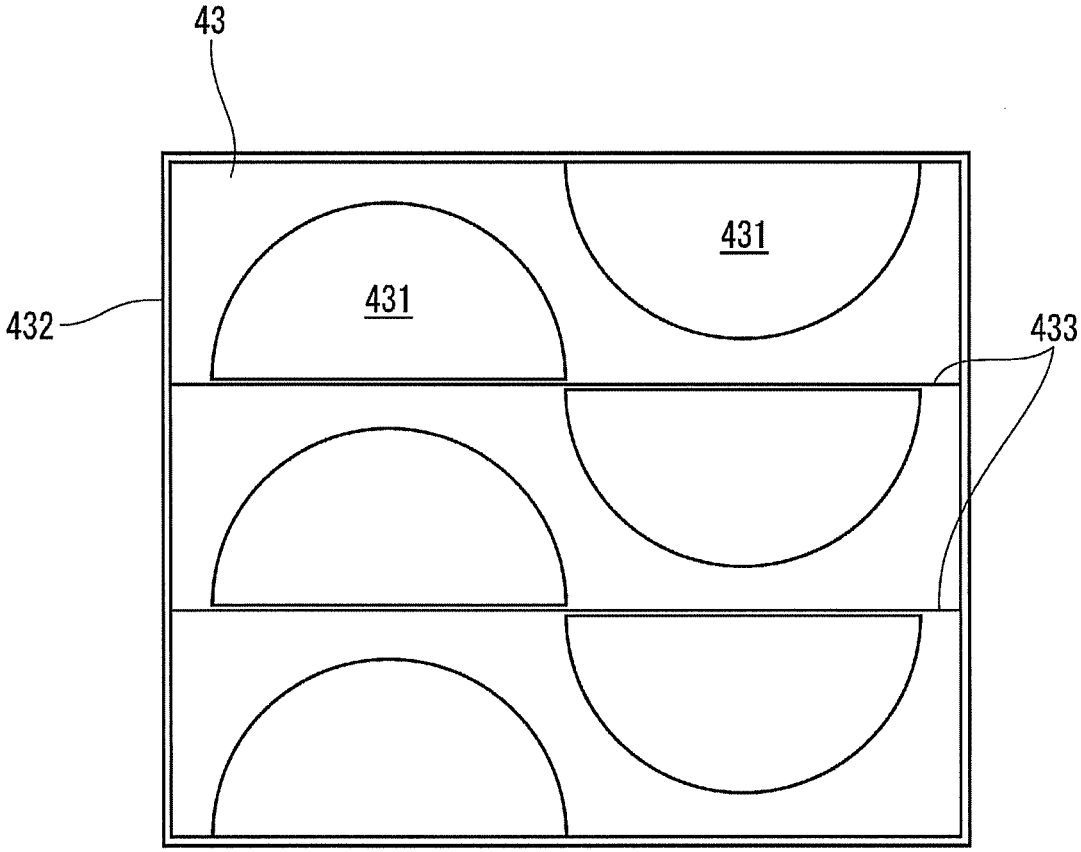
FIG. 6 is a plan view showing a reflector attachment plate.

Referring again to FIGS. 1 and 2, a reflector attachment plate 43 having six semicircular reflector openings 431 (see FIG. 6) is attached to the middle-height portion of the housing 20 so that the six reflectors 40 can be partially fitted to and supported by the reflector attachment plate 43. As shown in FIG. 6, a rectangular frame member 432 is provided in the peripheral edge portion of the reflector attachment plate 43. The outer peripheral surface of the frame member 432 is so sized and shaped that the frame member 432 can be accommodated within the housing 20.

As can be seen in FIG. 6, two rows of three reflector openings 431 (six reflector openings 431 in total) are provided in the opposite orientations to each other. Reinforcing ribs 433 serving also as louvers are provided on the surface of the reflector attachment plate 43 facing in the irradiation direction to extend between the adjoining reflectors 40. The reinforcing ribs 433 serve to enhance the rigidity of the reflector attachment plate 43 and to restrain the illumination light from being irradiated in other directions than a specified direction. The height of the reinforcing ribs 433 is set not to exceed the height of the frame member 432 (see FIG. 2).

The size of the reflector openings 431 of the reflector attachment plate 43 is set slightly smaller than the external dimension of the reflectors 40 measured at the level of the lower surface of the flange portion 45.

Therefore, if the reflectors 40 are inserted into the reflector openings 431 of the reflector attachment plate 43, the lower portions of the reflectors 40 protrude from the reflector attachment plate 43 in the opposite direction to the irradiation direction. Thus, the flange portions 45 of the reflectors 40 are brought into contact with and supported by the irradiation direction surface of the reflector attachment plate 43. Each of the reflectors 40 is fixed to the reflector attachment plate 43 by two screws 451 and 452 (see FIG. 1) provided at the opposite ends of the flange portion 45. This makes it possible to adjust the attachment angle of each of the reflectors 40 with respect to the reflector attachment plate 43. The height of the reflectors 40 is set such that the upper ends of the reflectors 40 do not protrude beyond the upper end of the frame member 432.

In the event that one of the LED units 30 has a trouble and needs to be replaced, the reflectors 40 can be easily removed together from the housing 20 while being kept in orientation-adjusted states by merely detaching the reflector attachment plate 43. Likewise, the reflectors 40 can be attached together while being kept in orientation-adjusted states by merely fixing the reflector attachment plate 43 to the housing 20.

Next, description will be made on the irradiation direction and range of the illumination light irradiated from the LED units 30.

Figure 11A:
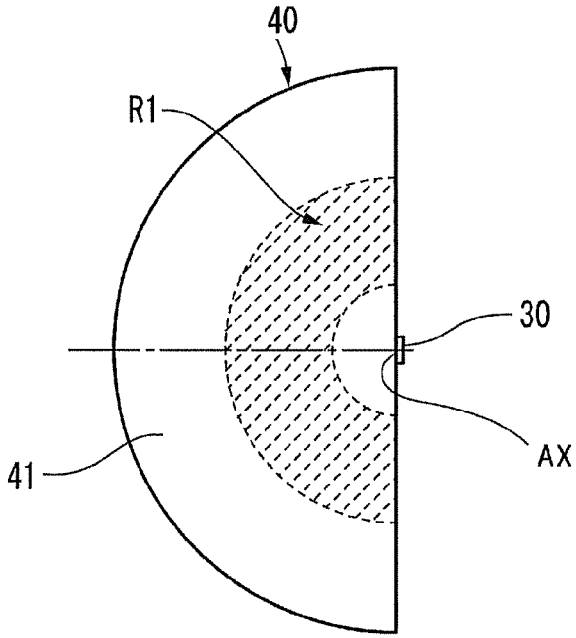
FIGS. 11A and 11B are plan and section views illustrating an effective reflection project plane obtained when each of the LED units is oriented in a direction orthogonal to the center axis of each of the reflectors.
Figure 11B:
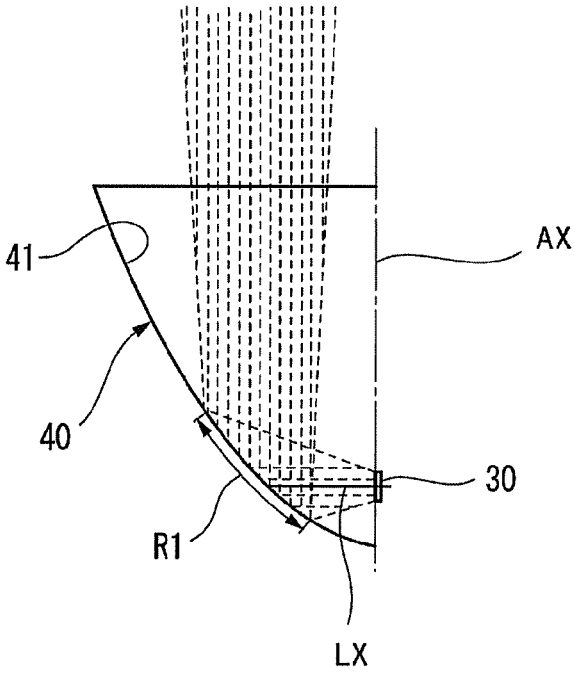

FIGS. 11A and 11B illustrate an effective reflection project plane obtained when the major optical axis LX of each of the LED units 30 is oriented in a direction orthogonal to the center axis AX of each of the reflectors 40 as is the case in the conventional illumination device. In this case, the illumination light emitted from each of the LED units 30 is directed in the direction substantially orthogonal to the center axis AX and is reflected by a lower limited area of the reflection surface 41 (namely, the effective reflection surface R1).

Figure 10A:
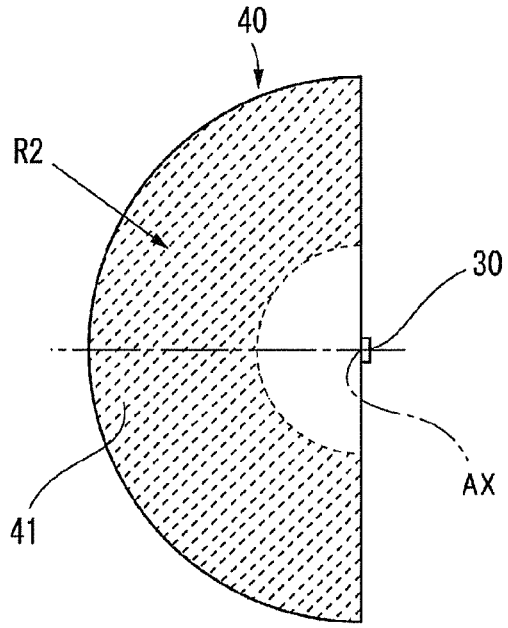
FIGS. 10A and 10B are plan and section views illustrating an effective reflection project plane obtained when each of the LED units irradiates light in a tilted posture.
Figure 10B:
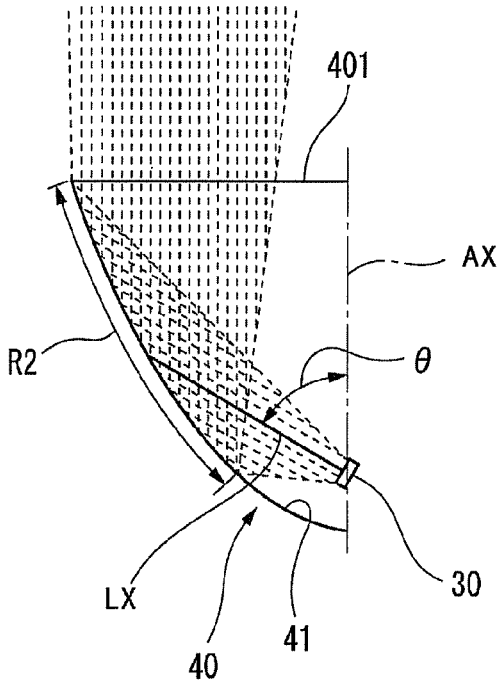

FIGS. 10A and 10B illustrates an effective reflection project plane obtained when the major optical axis LX of each of the LED units 30 is tilted with respect to the center axis AX of each of the reflectors 40, namely when the angle θ is set smaller than 90 degrees. In this case, the illumination light emitted from each of the LED units 30 is directed obliquely upwards with respect to the center axis AX and is reflected by the substantially entire area of the reflection surface 41 (namely, the effective reflection surface R2).

With the illumination device 10 of the first embodiment described above, the LED units 30 are attached to the specified positions of the housing 20 and the illumination lights coming from the LED units 30 are reflected by the reflectors 40 to be irradiated through the light-transmitting panel 24 of the housing 20. At this time, the reflectors 40 are attached to the reflector attachment plate 43. The orientations of the reflectors 40 are adjusted to allow the reflection surfaces 41 to reflect the illumination lights coming from the LED units 30 in specified directions. The reflector attachment plate 43 is removably attached to the housing 20. Therefore, the reflectors 40 can be removed together by detaching the reflector attachment plate 43. Likewise, the reflectors 40 can be attached together in specified orientations with no readjustment by merely fixing the reflector attachment plate 43 to the housing 20 in a specified position. This makes it possible to significantly enhance the work efficiency.

Since the reflector attachment plate 43 is provided with the reflector openings 431 to which the reflectors 40 are fitted partially, it is possible to fix the reflectors 40 having a generally conical shape in a reliable manner. The reflector attachment plate 43 serves also as a blinder for hiding the interior of the housing 20.

Owing to the fact that the reinforcing ribs 433 serving also as a louver are provided on the irradiation direction surface of the reflector attachment plate 43, it is possible to increase the rigidity of the reflector attachment plate 43 and to provide light interruption over a specified area as a louver does.

Inasmuch as the LED units 30 are attached to the heat-irradiating LED attachment blocks 31 fixed to the housing 20 through the heat-dissipating members 32, it is possible to efficiently transfer and dissipate the heat generated in the LED units 30.

Since the heat-dissipating members 32 holding the LED units 30 are interconnected and unified by the connection plates 34, it is possible to remove the LED units 30 and the heat-dissipating members 32 together. This assists in increasing the work efficiency. Since the heat of the heat-dissipating members 32 can be diffused and dissipated through the connection plates 34, it is possible to enhance the heat-dissipating effect.

Moreover, the reflection efficiency is improved because the LED units 30 are arranged such that the angle θ between the major optical axis LX of each of the LED units 30 attached near the bottom portions of the reflectors 40 and the center axis AX extending toward the large diameter opening 401 of each of the reflectors 40 becomes smaller than 90 degrees.

Figure 12:
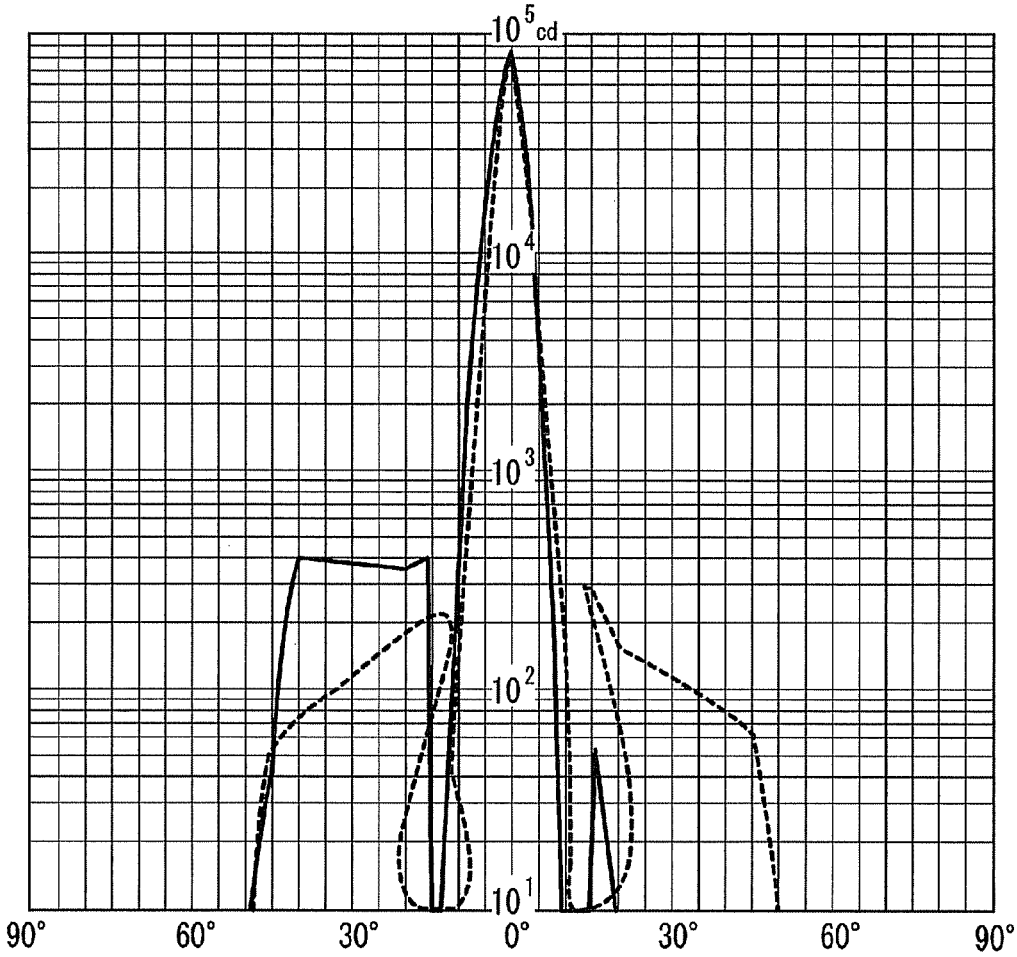
FIG. 12 is a graph representing a light distribution curve obtained when the angle between the major optical axis of each of the LED units and the center axis of each of the reflectors is set smaller than 90 degrees.
Figure 13:
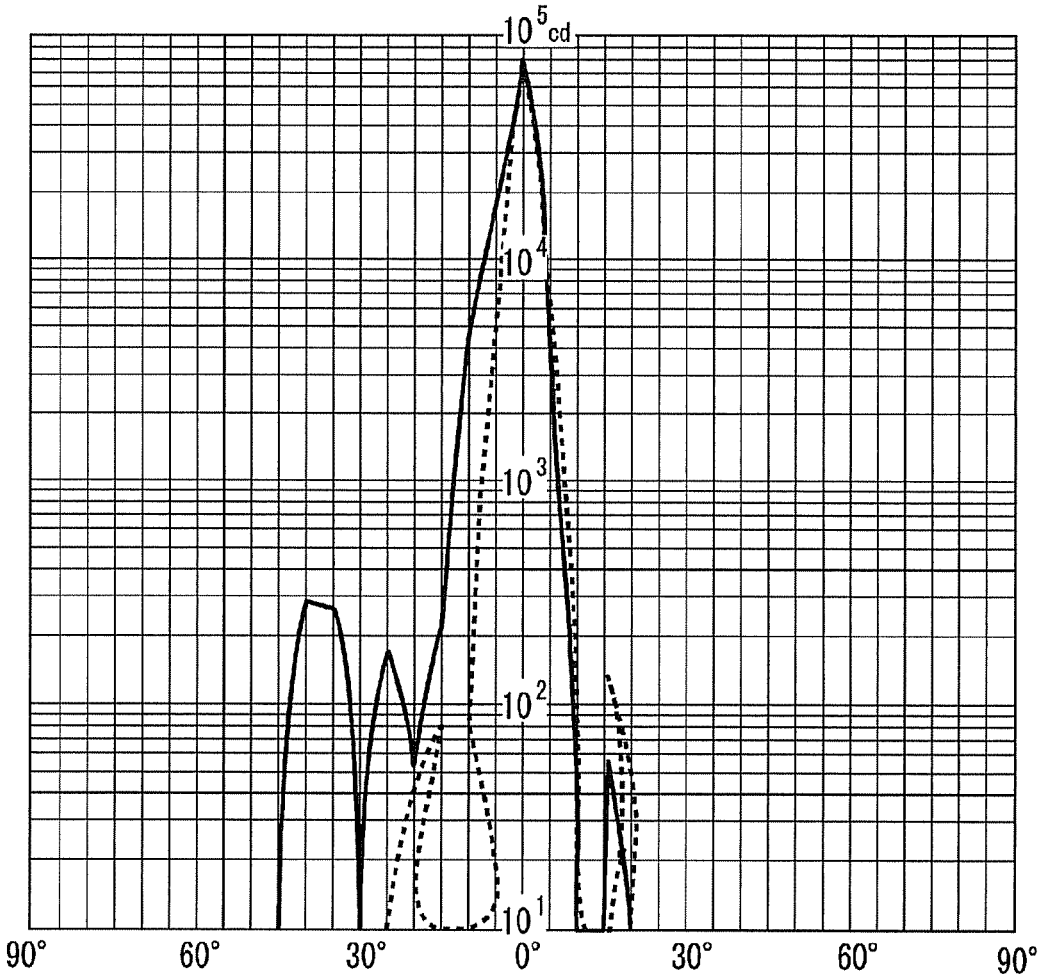
FIG. 13 is a graph representing a light distribution curve obtained when the angle between the major optical axis of each of the LED units and the center axis of each of the reflectors is set equal to 90 degrees.

FIG. 12 is a graph representing a light distribution curve obtained when the angle θ between the major optical axis LX of the LED unit 30 and the center axis AX of the reflector 40 is set smaller than 90 degrees. FIG. 13 is a graph representing a light distribution curve obtained when the angle θ between the major optical axis LX of the LED units 30 and the center axis AX of the reflector 40 is set equal to 90 degrees. Comparison of FIGS. 12 and 13 indicates that the reflection efficiency when the LED unit 30 is attached in a tilted posture is about 1.15 times as great as the reflection efficiency when the LED unit 30 is attached in a right posture.

Second Embodiment

Next, description will be made on an illumination device according to a second embodiment of the present invention. The same components as those of the illumination device of the first embodiment described above will be designated by like reference numerals and redundant description thereof will be omitted.

Figure 14A:
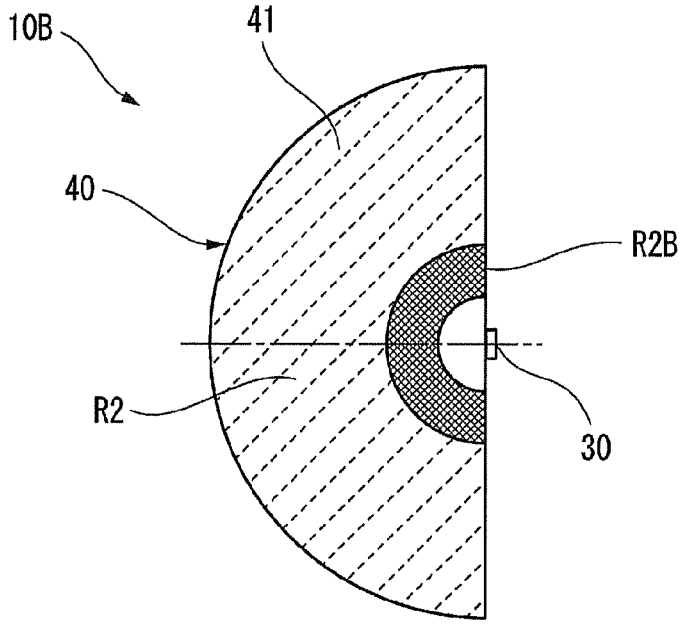
FIGS. 14A and 14B are plan and section views illustrating an effective reflection project plane obtained in an illumination device according to a second embodiment of the present invention.
Figure 14B:
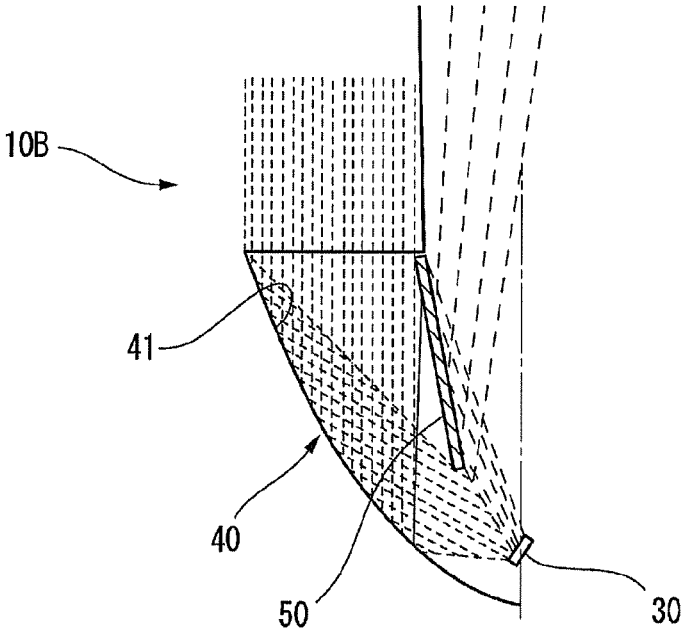
Figure 15:
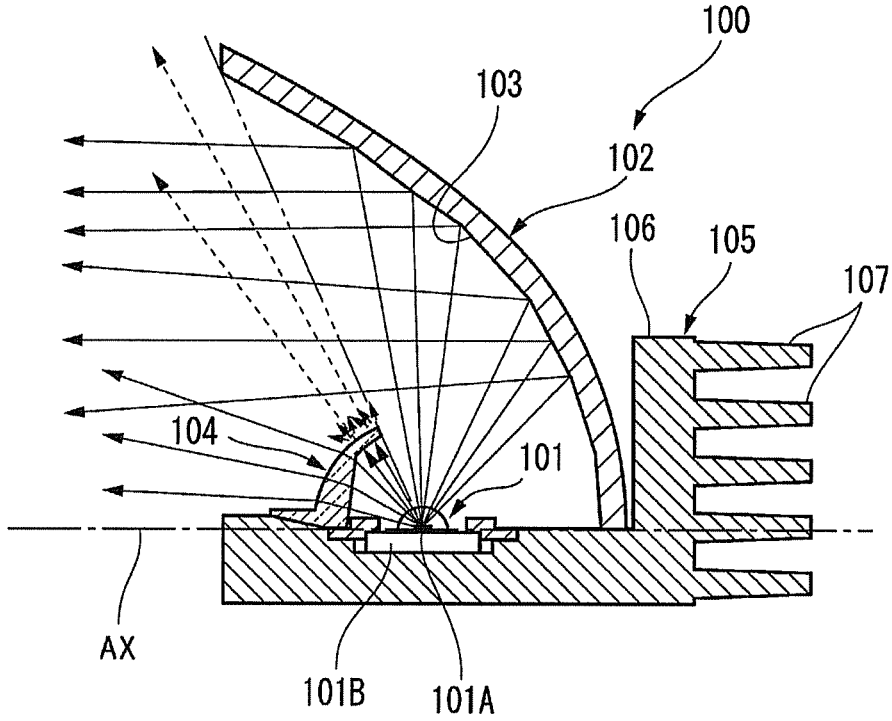
FIG. 15 (PRIOR ART)
FIG. 15 is a section view showing a conventional illumination device.

As shown in FIG. 14B, the illumination device 10B according to the second embodiment of the present invention includes reflection plates 50 for reflecting the lights, which are emitted from the LED units 30 but deviated from the reflectors 40, in a specific direction. The lower end of each of the reflection plates 50 is positioned on a line linking each of the LED units 30 and the large opening 401 of each of the reflectors 40. The upper end of each of the reflection plates 50 is positioned flush with the large opening 401 of each of the reflectors 40. The inclination of the reflection plates 50 is set such that the light emitted from each of the LED units 30 does not deviate from the large diameter opening 401.

As shown in FIG. 14A, each of the reflection plates 50 can provide an additional effective reflection surface R2B at the inner side of the effective reflection surface R2 provided when the reflection plates 50 are absent.

With the illumination device 10B of the second embodiment described above, the light irradiated to be deviated from the reflector 40 is reflected by the reflection plate 50 to travel along the specific direction. This makes it possible to increase the reflection efficiency and to cut the glaring light otherwise leaked from the reflectors 40.

The illumination device of the present invention is not limited to the foregoing embodiments but may be modified or improved in many different forms without departing from the scope and spirit of the invention defined in the claims.

What is claimed is:

1. An illumination device, comprising:

a housing having a light-emitting surface through which illumination light is irradiated;

a plurality of LED units fixed to the housing in specified positions to emit the illumination light;

a plurality of reflectors each having a reflection surface for reflecting the illumination light emitted from each of the LED units in a specified direction; and a reflector attachment plate removably fixed to the housing, each of the reflectors being adjustably attached to the reflector attachment plate in a specified orientation.

2. The device of claim 1, wherein the reflector attachment plate has reflector openings to which the reflectors are fitted partially.

3. The device of claim 1, wherein the reflector attachment plate includes a reinforcing rib provided on an irradiation direction surface of the reflector attachment plate, the reinforcing ribs also serving as a louver.

4. The device of claim 2, wherein the reflector attachment plate includes a reinforcing rib provided on an irradiation direction surface of the reflector attachment plate, the reinforcing ribs also serving as a louver.

5. An illumination device, comprising:

a housing having a light-emitting surface through which illumination light is irradiated;

a plurality of LED units for emitting the illumination light to be irradiated through the light-emitting surface;

a plurality of heat-dissipating LED attachment blocks fixed to the housing to hold the LED units in specified orientations, respectively; and a plurality of heat-dissipating members through which the LED units are attached to the LED attachment blocks, respectively.

6. The device of claim 5, further comprising:

a connection plate configured to interconnect and unify the heat-dissipating members.

7. An illumination device, comprising:

a housing having a light-emitting surface through which illumination light is irradiated;

at least one LED unit fixed to the housing in a specified position to emit the illumination light; and a reflector having a curvilinear reflection surface for reflecting the illumination light emitted from the LED unit in a specified direction, wherein the LED unit is arranged near a bottom portion of the reflector such that the angle θ between a major optical axis of the LED unit and a center axis of the LED unit extending toward a large opening of the reflector becomes smaller than 90 degrees.

8. The device of claim 7, further comprising:

a reflection plate configured to reflect the illumination light, which is emitted from the LED unit but deviated from the reflector, in a specific direction.

* * * * *